United States Patent [19]

Barnett

[11] 4,144,811

[45] Mar. 20, 1979

[54] FORM ROLLER COMPENSATOR

[75] Inventor: Edward R. Barnett, Westminster, Calif.

[73] Assignee: Beach Manufacturing Corporation, Huntington Beach, Calif.

[21] Appl. No.: 856,781

[22] Filed: Dec. 2, 1977

[51] Int. Cl.[2] ..... B41L 27/34; B41F 31/32

[52] U.S. Cl. ..... 101/349; 101/209

[58] Field of Search ..... 101/348, 349, 350, 351, 101/352, 204, 205, 206, 216, 209, 247, 182, 148, 139, 140; 118/262; 308/31–33, 15, 22; 100/168

[56] References Cited

U.S. PATENT DOCUMENTS

| | | | |
|---|---|---|---|
| 2,163,374 | 6/1939 | Crafts | 101/349 |
| 2,853,005 | 9/1958 | Worthington | 101/365 |
| 2,860,579 | 11/1958 | Granger | 101/348 |
| 3,167,010 | 1/1965 | Worthington et al. | 101/349 |
| 3,638,568 | 2/1972 | Granger | 101/247 X |
| 3,986,454 | 10/1976 | Granger | 101/247 |

*Primary Examiner*—J. Reed Fisher

*Attorney, Agent, or Firm*—Fulwider, Patton, Rieber, Lee & Utecht

[57] ABSTRACT

A form roller compensator is provided for use in mounting a printing form roller in a publication printing apparatus in proper orientation relative to a printing cylinder. The form rollers in a printing machine control the amount of ink transferred to the printing surfaces of a printing cylinder for printing alphabetic and numerical characters and pictorial illustrations. The invention allows the amount of ink transferred by printing form rollers to be varied to compensate for the inordinately heavy or light supply of ink which results from pressure variations of the form rollers against impression cylinders. These pressure variations are caused by thermal expansion or contraction of the various rotating cylinders involved.

8 Claims, 6 Drawing Figures

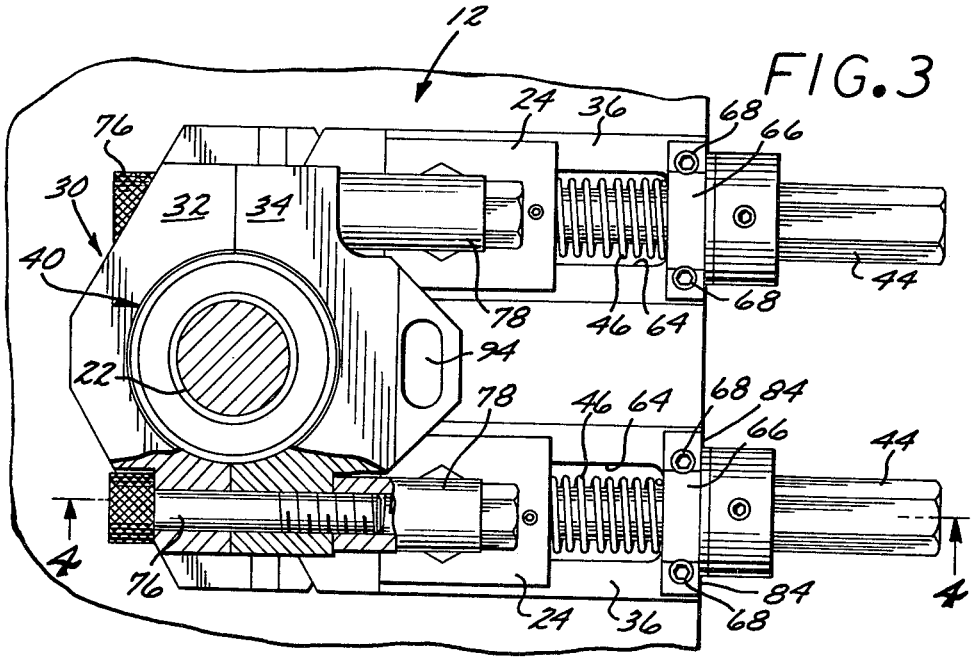
FIG. 3
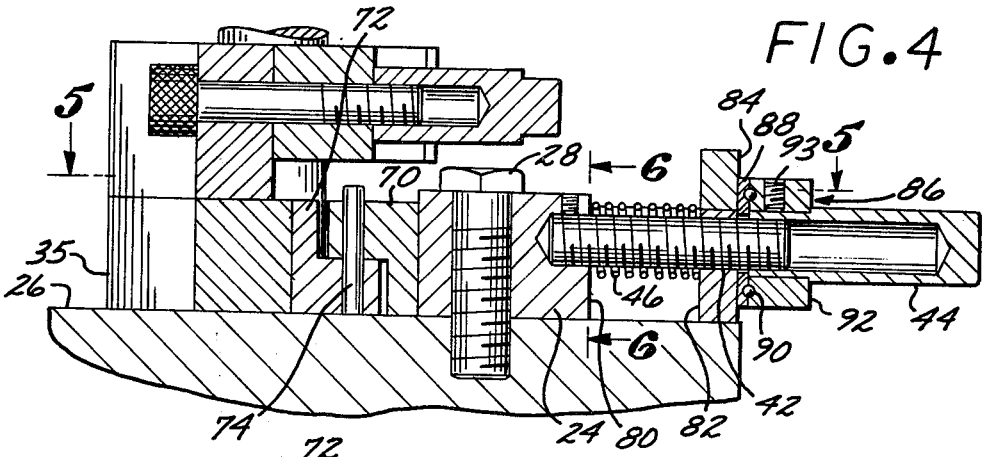
FIG. 4
FIG. 5
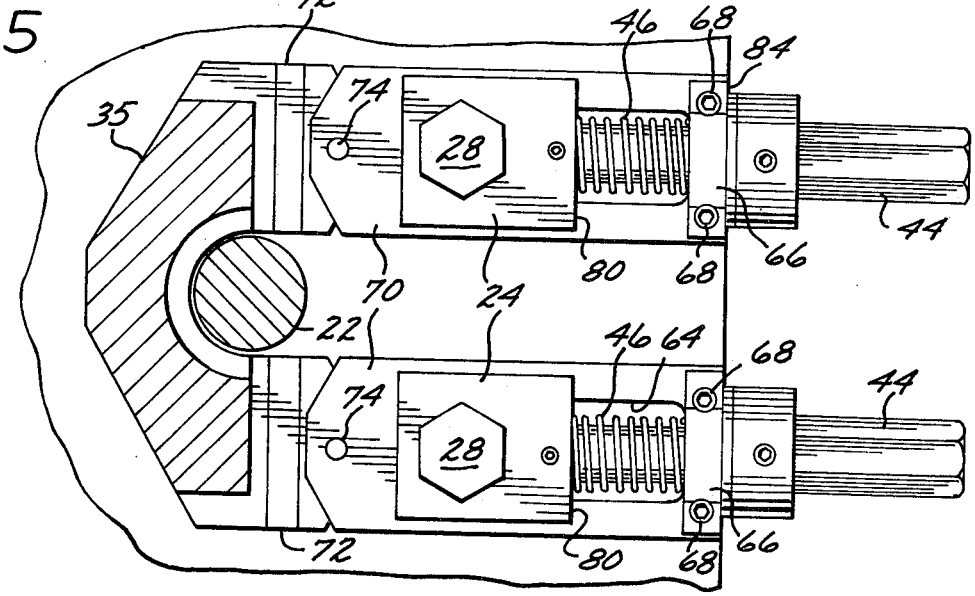

FORM ROLLER COMPENSATOR

BACKGROUND OF THE INVENTION

1. Field of the Invention

The present invention relates to machines used for high volume printing of newspapers, magazines and other publications in which ink is applied to the printing surfaces of a rotating printing cylinder and carried to and impressed upon a print medium.

2. Description of the Prior Art

A high volume printing system employs a number of rotating cylinders, which together from a printing train. A running web of print medium, normally paper, is fed across and driven in contact with a rotating cylindrical roller. This rotating cylinder is termed an impression cylinder in the printing trade. A printing cylinder is located proximate to the impression roller on the opposite side of the traveling paper web. The printing cylinder has a surface to which are fixed convex arcuate plates, the outer surfaces of which bear type print of alphabetic and numerical characters elevated slightly above a convex curved surface. Also, for pictorial illustrations, the surface of the printing cylinder includes a print screen carrying areas of dots elevated above the curved surface and grouped to form light or dark shaded areas. As the printing cylinder rotates, the raised printing surfaces elevated above the convex curved support are brought into contact with the traveling paper web. Ink applied to these elevated surfaces is thereby transferred to the paper web as the figures and characters on the impression cylinder are rotated into contact therewith.

Cylindrical form rollers are positioned in contact with the printing cylinder and bear against the impression cylinder to force it toward the impression cylinder. The rotating form rollers also turn in contact with an ink roller and pick up ink therefrom to transfer that ink to the printing cylinder. The ink roller, in turn, is rotated and is concurrently longitudinally reciprocated some distance along the form rollers so that ink is distributed evenly across the cylindrical form roller surfaces. Because of its reciprocal movement relative to the form roller, the ink roller is sometimes termed a vibrator. The ink roller acquires the ink for ultimate transportation to the printing cylinder from a rotating cylindrical rubber spreader which is interposed between the ink roller and another cylindrical pickup roller that turns in a trough of ink.

All of the cylindrical rollers involved in a printing train are orientated to rotate about parallel axes. Conventional practice is to arrange printing cylinder trains of the type described in pairs upon a single framework. The normal orientation of the cylinder trains is such that when a pair of printing trains is positioned back to back on a single framework, as viewed from the end of the framework the rollers of the printing trains together roughly define an inverted horseshoe shaped array of cylinders. Accordingly, the frameworks themselves are constructed generally in the shape of an inverted U, or inverted horseshoe.

For some time, problems have existed in the movement of ink along the rollers for utlimate printing on the paper web. Specifically, even the slightest maladjustment of the system can result in an absence of ink on some of the character surfaces on the printing roller to which ink should be applied for printing on the paper web. Alternatively, excessive ink or excessive pressure of the form rollers against the printing cylinder causes ink marks to appear on the paper between the printing surfaces of the printing cylinder. It is the purpose of the form rollers to remedy such defective printing by varying the pressure of contact of the printing cylinder against the paper web. This variation is achieved by movement of the form rollers normal to their own axes to alter the degree to which they bear against the printing cylinder, which in turn adjusts the degree to which the printing cylinder is forced against the paper web.

To alter pressure of the form rollers against a printing cylinder, the axles of the form rollers are moved to alter their distances from the printing cylinder. Previously, form rollers were mounted in heavy bearing races which were securely affixed to the horseshoe shaped frames upon which the cylinders of the printing trains were mounted at either end. The bearing races were constructed of semi-circular halves which parted along a vertical plane and which were bolted together. At each frame, one of the bearing race halves for each form roller included an anchoring mounting which was reciprocally movable in a plane perpendicular to the form roller axis relative to an associated mounting block bolted to the printing train framework at that end of the form roller. To alter the disposition of the form rollers relative to the printing cylinder, the semi-circular bearing race halves were unbolted, the form rollers were removed, and the anchoring mountings were laterally adjusted relative to the mounting blocks. Separate adjustments could be made at both the top and bottom of each bearing race, so that both translational and rotational movement of the form roller axes relative to the print cylinder mounting framework was possible. However, because disassembly of the bearing races was required, and because the form roller had to be removed incident to any adjustment thereof, form roller adjustment to achieve proper roller disposition was a lengthy, arduous process.

Another type of form roller adjustment device was developed in an attempt to obviate the difficulties present in the adjustment of the disposition of form rollers relative to printing cylinders theretofore encountered. Such devices were termed automatic roller adjusters or automatic roller compensators and are found on printing presses manufactured by or for Miehle-Goss-Dexter, Incorporated of Chicago, Illinois and marketed as operating parts of the Mark I or Mark II printing presses. Similar compensators are provided in printing presses manufactured by the Woods-Hoe Company of Middlesex, New Jersey. In these types of automatic roller compensators, form roller bearing races are again constructed in semi-circular sections. Rather than being completely separable, however, these bearing races are hinged at one junction and releasably bolted together at a diametrically opposite junction. Thus, an opening half of the bearing race can be rotated outward relative to the other static bearing race half to allow removal and reinsertion of a form roller. The static bearing race half is itself mounted about a rotatable connection relative to the print cylinder frame. However, this static bearing race half is held practically immobile by a heavy spring interposed between it and the print cylinder frame with the spring exerting force on the bearing race to bias the form roller towards the printing cylinder. The spring is supposed to yield to compensate for thermal expansion of the form roller, but as the spring is compressed, it forces the form roller toward the printing cylinder with an increased force. Movement of the bearing race by the spring is opposed and restrained by an adjustable connection between the static bearing race half and the print cylinder framework located at a distance from the rotatable connection of the static bearing race half to the frame work. The adjustable connection is in the form of a threaded rod extending into a tapped block associated with the static bearing race half to restrain movement of the form roller toward the printing cylinder under the influence of the heavy spring.

The disposition of the bearing race relative to the roll cylinder mounting framework is further influenced by a camming arrangement at the end of the threaded rod which allows the static bearing race half to be moved in rotation in major steps between discrete points of adjustment relative to the impression cylinder. A further aspect of the camming arrangement allows the threaded rod to rotate the static bearing race relative to the framework in much smaller incremental steps about the rotatable connection thereto. Because of the cam arrangement associated with the threaded interaction of the adjustment rod relative to the bearing race, the extent to which the rod is engageable with the bearing race is alterable only by stepwise adjustment.

The prior art has therefore failed to provide a system that adequately allows in service adjustment of the disposition of printing form rollers relative to each other. The prior art adjustment systems have heretofore required that printing cease while adjustment of the positions of the form roller bearing races is performed. In any continous high speed printing operation, an adjustment which brings printing to a halt for any period of time, however brief, is extremely costly and time consuming to the overall printing operation. Moreover, prior art techniques and devices have not provided the precision of adjustment necessary to adequately compensate for such variables as thermal expansion and contraction of the form rollers and printing cylinder. These thermal effects, though slight in magnitude, have a significant effect on print quality.

SUMMARY OF THE INVENTION

It is an object of the present invention to provide a means for adjusting the degree to which a form roller bears against a printing cylinder in a high speed publication printing system without halting the printing operation. To achieve this, a pair of laterally directed continuously adjustable devices are provided to allow the positions of the form roller bearing races to be continously altered.

By providing for in service position adjustment of the form rollers, and by providing a system in which adjustments are not limited to stepwise increments, the present invention greatly increases the degree of precision of adjustment available. As a consequence, the present invention allows for adjustments to be made in form roller disposition to properly compensate for thermal expansion and contraction of the rotating printing cylinders, without increasing the force pushing the cylinders toward each other.

When a train of print rolls is first put into operation, which typically occurs in the early morning hours, the ambient room temperature in which the printing machines are located is normally relatively cool. Likewise, the metal surfaces of the print train cylinders themselves, after having been at rest, are normally at a relatively low temperature. Because of the large mass of the print train cylinders, operation of the printing machine with the print cylinders rotating in contact with each other generates a great deal of heat due to friction. Moreover, as activity in the immediate surroundings increases and as more operating personnel arrive to supervise the operation of the printing machines, ambient air temperature is increased. It is not at all uncommon for temperature change of 10° Farenheit in the temperature of the print cylinders to occur within an hour of commencement of printing operations. This is especially true in relatively large printing establishments where a number of printing machines are situated within a single room. All of these temperature changes have a considerable effect on print quality due to the coefficient of thermal expansion of printing cylinders. Typically printing cylinders are formed of steel or aluminum, some of which are encased in rubber sleeves. All of the materials involved have large coefficients of thermal expansion. As a result, the diameters of both the form rollers and printing cylinders tend to increase, thereby increasing the pressure which the form rollers exert against the printing cylinder. This pressure is in turn transmitted from the printing cylinder to the traveling web of print medium, so that ink from interstitial spaces between print font surfaces on the printing cylinder is impressed upon the web of print medium, absent some adjustment.

Fortunately, the present invention allows just such an adjustment to be made while the printing presses continue to operate. This further increases the obtainable precision in adjustment, since cessation of rotation of the print cylinders effects the temperature thereof, thus obfuscating the degree of adjustment which is desirable in conventional adjustment mechanisms.

According to the invention, adjustments can be made to reposition the form roller bearing races on an empirically derived adjustment schedule. That is, from experience it can be determined that, for example, a specified integral or fractional number of counter-rotations of the upper adjustment mechanism are required one-half hour following commencement of the printing operation. Also, a different degree of reverse adjustment may be required 45 minutes thereafter, and so forth. In this way, a complete printing operation can be performed without the necessity for interruptions while maintaining a print quality equal or superior to that achieved with prior art systems.

DESCRIPTION OF THE DRAWINGS

FIG. 3 is a side elevational view of a right hand form roller compensator of the invention.

FIG. 4 is a sectional view taken along the lines 4—4 of FIG. 3.

FIG. 5 is a sectional view taken along the lines 5—5 of FIG. 4.

DESCRIPTION OF THE EMBODIMENT

Figure 1:
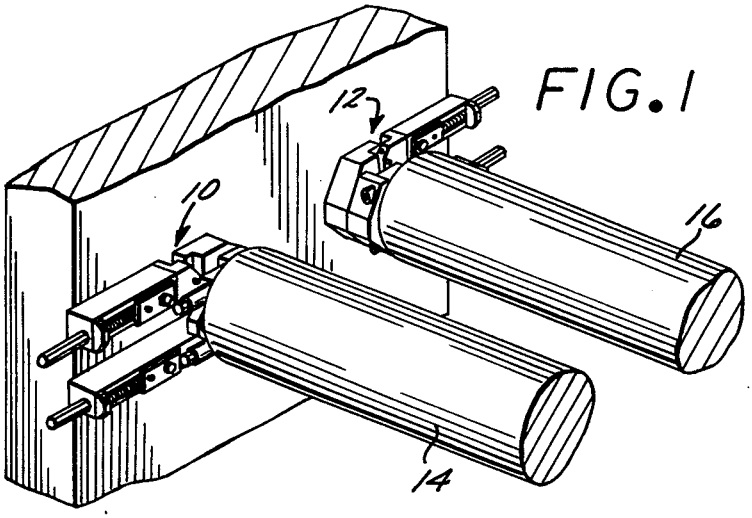
FIG. 1 is a perspective view of a pair of form rollers and adjustable bearing races according to the invention.
Figure 6:
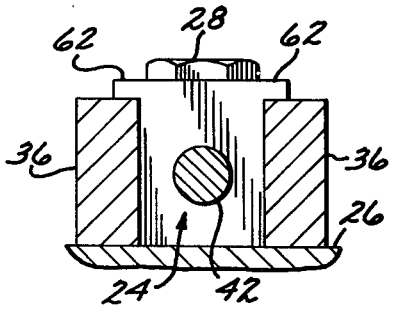
FIG. 6 is a sectional view taken along the lines 6—6 of FIG. 4.

FIG. 1 illustrates a pair of adjustable bearings 10 and 12 for mounting cylinder rolls, such as the form rollers 14 and 16, in a printing train. A pair of left and right hand printing trains 18 and 20 respectively are depicted generally in FIG. 2. Since the print rollers are mounted between opposing upright supports, each print roll requires a left hand bearing, such as the bearing 10, and a right hand bearing, such as the bearing 12. As illustrated in FIG. 3, each of the form rollers is carried by a rotatable shaft 22 protruding longitudinally beyond the ends of the outer surfaces of the cylinder rolls. The adjustable bearings 10 and 12 each include upper and lower guide blocks 24 of T-shaped outer cross sectional configuration as depicted in FIG. 6. The guide blocks 24 are mounted upon a leg of the inverted horseshoe-shaped print roller train frames 26, one of which is visible in FIG. 2. The guide blocks 24 are vertically displaced from each other and extend horizontally in a plane perpendicular to the axis of the form roller cylinder 14 or 16 with which they are associated. The guide blocks 24 are securely attached to the print roller train frame 26 by means of machine bolts 28, as depicted in FIGS. 4 and 6.

A bearing mount 30 includes a pair of bearing race support sections 32 and 34 with semi-circular bearing surfaces defined therein positioned in face to face relationship to define a cylindrical well to accomodate the shaft 22, is depicted in FIG. 3. The bearing support section 32 is rigidly secured to and moves with a support yoke 35, positioned to ride in contact with the surface of the frame 26. The suport yoke 35 is of a geometric configuration corresponding roughly to that of the bearing section 32. The bearing mount 30 also includes vertically displaced horizontally extending legs 36, rotatably connected to the extremities of the support yoke 35, and by means of which the bearing mount 30 is connected to the guide blocks 24 and is reciprocally movable therealong. Entrapped within the shaft wells formed by the bearing support sections 32 and 34 are annular bearings 40, depicted in FIG. 3. The bearings 40 are rigidly attached to the bearing mount 30, and each bearing 40 is disposed to carry an end of the shaft 22 of one of the cylinders 14 or 16. Externally threaded adjustment studs 42, internally threaded adjustment tubes 44, and biasing coil springs 46 interact with the legs 36 of the bearing mount 30 to form an adjustable positioning means. The threaded stud 42, annular tubes 44, and biasing springs 46 are used to move the bearing mounts 30 to a selected position relative to the guide blocks 24 and to hold the bearing mount 30 at the position selected.

Figure 2:
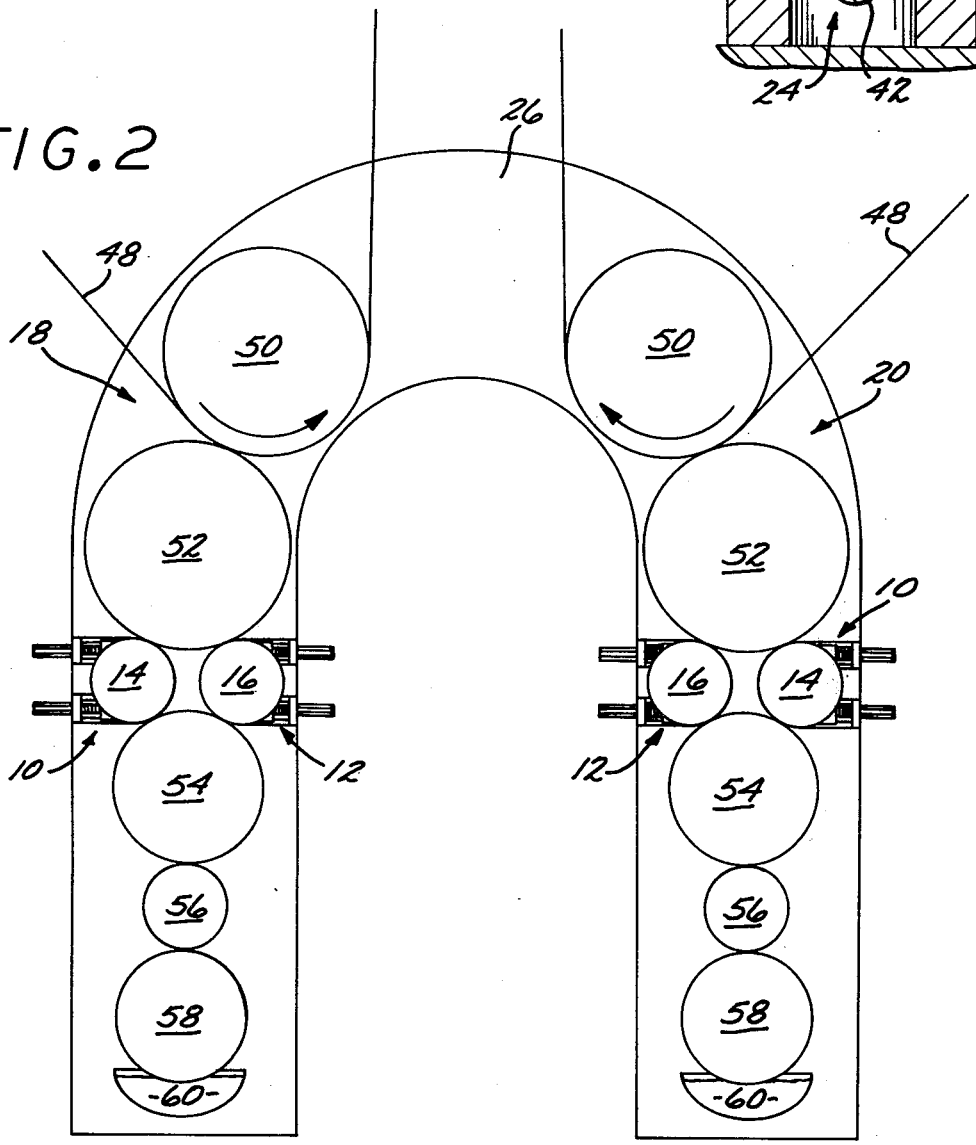
FIG. 2 is a side elevational view of a print roller frame in upon which a pair of print roller trains are mounted.

FIG. 2 illustrates the orientation of the different print rolls relative to the framework sections 26. Elongated webs 48 of sheets of paper of a width commensurate with the spacing of the framework sections 26 are stored on spools (not shown) and fed onto smooth surfaced stainless steel impression cylinders 50, which are rotated in directions as indicated. Beneath the impression cylinders 50, printing cylinders 52 rotate and carry the print type on printing saddles and plates. The print type is arranged on the outer convex cylindrical surfaces of the printing rollers 52, and is coated with ink in order to repetitiously print material with each rotation upon the paper web 48 as the paper web 48 passes between the printing cylinder 52 and the impression cylinder 50 associated therewith. Form rollers 14 and 16 transport ink to the printing cylinders 52 and maintain lateral pressure to force the printing cylinder 52 against the paper web 48, which in turn is backed by the impression cylinder 50. This pressure, and the amount of ink carried from the form rollers 14 and 16 to the printing cylinders 52, is varied by means of the adjustable bearings 10 and and 12 according to the invention.

A vibrator 54 in each of the print trains 18 and 20 reciprocates back and forth along its own axis to ensure a uniform coating of ink which it carries to the form rollers 14 and 16. A spreader 56 is located beneath each vibrator 54 and is used to carry ink from the pickup roller 58 located therebeneath. Each of the pickup rollers 58 rotates in contact with ink in a trough or fountain 60. Through each print train, ink is carried up the cylinder rolls 58,56,54,14 and 16 to the printing cylinder 52, and is impressed in the configuration of letters, numerals and pictorial illustrations recurringly at intervals along the paper 48, as the paper webs 48 are passed between the printing cylinders 52 and impression cylinders 50.

The adjustable bearings 10 and 12 may be used to alter the location of the axes of the form rollers 14 and 16, and hence affect printing by the printing cylinder 52, while the print trains 18 and 20 are in operation. Adjustment is performed manually by rotation or counter rotation of adjustment tubes 44, which are elongated nuts of hexagonal outer surface configuration and which are internally threaded so that they may be moved toward or away from the mounting blocks 24.

The inverted U-shaped framework sections 26 form upright standards vertically oriented to carry the several print rolls of the print cylinder trains 18 and 20 in parallel orientation. As previously noted, the T-shaped mounting blocks 24 are firmly fastened to the framework sections 26 by means of machine bolts 28 as illustrated in FIGS. 4 and 6. The top surface flanges 62 of the guideblocks 24 overhang the structure of the bifurcated horizontally extending legs 36 of the bearing mount 30. The legs 36 of the bearing mount 30 have an outer shape generally in the form of a rectangular prism, and are each of a bifurcated structure constructed with a transversely extending horizontally opening slot 64 therein, closed at either end. The structure of the mounting blocks 24 is such that the overhanging flanges 62 do not clamp the legs 36 against the framework sections 26, but rather the legs 36 may be longitudinally moved relative to the guide blocks 24 under the control of the threaded adjustment stud 42.

The legs 36 are reciprocal relative to the guide blocks 24 with the overhanging flanges 62 of the guide blocks 24 the vertical surfaces of the framework 26, and the horizontal surfaces of the guide blocks 24 confining the movement of the legs 36 to horizontal reciprocation in a plane substantially perpendicular to the axis of the form roller shafts 22.

At the extremities of the legs 36 adjacent the adjustment tubes 44, inwardly disposed arcuate brackets 66 cap lateral openings in the end walls of the arms 36 and are fastened thereto by allen head screws 68 as illustrated in FIGS. 3 and 4. At the opposite ends of the arms 36, the end walls thereof are formed with overhanging ledges 70 directed toward the bearing support sections 32 and 34 of the bearing mounts 30 as depicted in FIGS. 4 and 5. The overhanging ledges 70 ride upon the upper surfaces of undercut L-shaped brackets 72, as depicted in FIG. 4. Cylindrical connecting posts 74 extend longitudinally substantially parallel to the axes of the form roller shafts 22 to rotatably couple the ledges 70 to brackets 72.

The brackets 72 are firmly affixed to either end of the support yoke 35 which rides in sliding contact with the surface of the frame 26. The bearing section 32 defines a longitudinally extending arcuate surface of semi-circular cross section. Together with a corresponding arcuate surface of semi-circular cross section of the opposing bearing section 34, the bearing support sections 32 and 34 define a cylindrical bearing well, within which the annular bearing race 40 is trapped. The bearing support sections 32 and 34 are releasably secured together by means of transverse threaded roller adjuster bolts 76 having knurled heads as depicted in FIGS. 3 and 4. The heads of the bolts 76 protrude from sockets in the bearing support section 32 while the shanks thereof extend therethrough and through the bearing support section 34. The bearing support sections 32 and 34 are clamped in juxtaposition by means of internally threaded clamping nuts 78 of tubular configuration. The extremities of the clamping nuts 78 remote from the heads of the bolts 76 are hexagonally shaped to accomodate manipulation through the use of a wrench. When clamped in place in the manner depicted in FIG. 3, the bearing support sections 32 and 34 entrap and immobilize the bearing race 40 between the opposing semi-circular surfaces defined therein. The end of a shaft 22 extends into an annular bearing race 40 adjacent to each of the frameworks 26 to mount the form rollers 14 and 16 for rotation.

The compressed coil springs 46 encircle the threaded adjustment studs 44 and exert a force between the outwardly directed surfaces 80 of the guide blocks 24, visible in FIGS. 4 and 5, and the inwardly directed surfaces 82 of the end walls of the legs 36 of the bearing mounts 30. Thus, as viewed in FIGS. 3, 4, and 5, the springs 46 tend to carry the annular bearing races 40 to the right except as the outer surfaces 84 of the end walls of the legs 36 are restrained by the adjustment tubes 44. The adjustment tubes 44 bear against collar assemblies 86. The collar assemblies 86 each include an adjustment index disk 88 with a central aperture therein through which a threaded adjustment stud passes. One surface of each disk 88 bears against the outer surface 84 of the end wall of a leg 36 of a bearing mount 30. The opposing surface of the disk 88 defines a plurality of semi-circular depressions spaced in a circle to receive a plurality of steel spheres 90. The steel spheres are entrapped between the index ring 88 and an adjustment indicator ring 92, which has corresponding inwardly facing depressions to receive the spheres 90. The indicator ring 92 in turn is held in position to entrap the spheres 90 by an overhanging shoulder of the tube handle 44, visible in FIG. 4. The indication ring 92 is held in position to turn with an associated adjustment tube 44 by a set screw 93. The spheres 90 do not impede continuous adjustment of the position of the bearing mount 30 as that position is altered by rotation of the adjustment tubes 44, but an individual turning the adjustment tubes 44 receives a tactile vibration each time the adjustment indicator ring 92 passes through a distance between spheres 90. This allows the operator to keep track of the degree to which adjustment is made in any setting alteration. This is a particular valuable feature in large printing operations where the rapid movement of the heavy print rollers generates a great deal of noise.

As an additional means of keeping track of the degree of adjustment performed, the adjustment index ring 88 and the adjustment indicator ring 92 may be equipped with calibration markings so that the degree of adjustment may be controlled. Despite any prescribed program of adjustments, however, it is still possible for very slight unpredictable variables to occur which will result either in print failing to appear with the requisite contrast on the paper web 48 or for darkened areas to appear between proper print locations on the paper web 48 due to excessive pressure or an excessive quantity of ink. Print quality can be monitored by an examination of the web 48 as it emerges from the print roller train 18 or 20, and the adjustment tubes 44 can be manipulated to obtain as fine a degree of adjustment as desired in order to obtain the requisite print quality.

In the operation of the invention, printing is commenced by feeding the paper web 48 onto the impression cylinders 50 and concurrently rotating the print rollers in the associated print roller train 18 or 20. As heat of friction from contact between the rollers in the print roller trains 18 and 20 as generated, the effects of thermal expansion become evident as the diameter of the print rollers increases slightly. As a result, there is a tendency for the printing cylinder 52 to be forced too heavily against the paper web 48 as the paper passes across the impression cylinder 50. This effect is alleviated by counterclockwise rotation of the adjustment tubes 44 individually to the requisite degree. Counterclockwise rotation of the upper adjustment tube 44 of each of the adjustable bearings 10 and 12 will relieve pressure from the printing cylinder 52 while still continuing to transfer substantially the same amount of ink from the vibrator 54. Conversely, counterclockwise rotation of the lower adjustment tubes 44 of the adjustable bearings 10 and 12 will maintain continued pressure on the printing roller 52, but will decrease the amount of ink transferred from the vibrator 54. Selective adjustment of the upper and lower adjustment tubes 44 of each of the adjustable bearings 10 and 12 is performed in a pattern derived empirically to achieve the most satisfactory print quality.

As can be seen by reference to FIGS. 3 and 5, counterclockwise rotation of the lower adjustment tube 44 to the exclusion of the upper adjustment tube 44 will allow the lower spring 46 to expand, thereby forcing the lower leg 46 of the bearing mount 30 to the right. This movement allows the lower overhanging ledge 70 to pull laterally on the post 74, thereby causing relative rotation between the ledge 70 and the lower bracket 72. The yoke 35 is thereby rotated about the upper post 74, with the result that the shaft 22 moves in a slight arcuate path upward and to the right. This tends to draw the form roller 16 away from the vibrator 54 while maintaining essentially the same pressure on the printing cylinder 52. Conversely, counterclockwise rotation of the upper adjustment tube 44 to the exclusion of adjustment of the lower tube 44 will have exactly the opposite effect. That is, the upper spring 46 is allowed to expand thereby rotating the yoke 35 about the lower connecting post 74 to draw the form roller 16 away from the printing cylinder 52 while still maintaining essentially the same degree of contact with the vibrator 54.

Concurrent counterclockwise rotation of both the upper and lower adjustment tubes 44 of an adjustable bearing 10 or 12 draws the associated form roller 14 or 16 laterally away from the printing cylinder 52 and the vibrator 54. As a result, contact between the form roller and the cylinder 52 and vibrator 54 is decreased. In contrast, clockwise rotation of both the upper and lower adjustment tubes 44 will result in horizontal translational movement of the yoke 35 toward the opposing form roller. This carries the shaft 22 horizontally inward toward the opposing form roller in FIG. 2 and increases contact between the adjusted form roller with both the printing cylinder 52 and vibrator 54. Counterclockwise rotation of only the upper tube 44 will tend to force the form roller downward primarily toward the vibrator 54, while adjustment of the lower tube 44 tends to force the form roller upward to a greater degree of exert increased pressure on the printing cylinder 52. As previously noted, the degree of adjustment of both the upper and lower adjustment tubes 44 should be determined empirically for each system. The degree of adjustment is sensed by interaction of the adjustment index ring 88, the adjustment indicator ring 92 and the spheres 90.

The form rollers can be removed and replaced by disengaging the clamping nuts 78 from the threaded shanks of the roller adjuster bolts 76. This separates the bearing support sections 32 and 34. The bearing support section 34 may be removed entirely by grasping its structure fingerhold at the depression 94 and exerting a lateral force outward away from the bearing support section 32. The form roller 14 or 16 may then be laterally removed, with the shaft 22 carrying the annular bearing races 40 therewith. Such removal is typically required for cleaning or for replacement of the form rollers.

While but a single embodiment of an adjustable bearing is depicted in detail in the drawings, it should be understood that both a left hand bearing and a right hand bearing are required for each roller. Also, while the invention has been depicted in connection with use for supporting form rollers, it is equally applicable to the support of any other cylinder in the print roller train 18 or 20. Numerous variations and modifications of the invention will undoubtedly become readily apparent to those familiar with high speed printing operations. Accordingly, the invention should not be considered as limited to the embodiments depicted in the drawings, but rather is defined in the claims appended hereto.

I claim:

1. Adjustable bearings for mounting a cylinder on a rotatable shaft between upright standards in a printing machine, each comprising:

a pair of vertically separated guides extending horizontally in a plane perpendicular to the axis of said cylinder for attachment to an upright standard, an articulated bearing mount supported by said guide means and comprising a support yoke having opposing ends and a pair of elongated legs each carried in horizontally adjustable disposition relative to an associated one of said guides and rotatably connected to an associated one of said opposing ends of said support yoke, thereby allowing articulated relative movement of said support yoke and said legs in a plane perpendicular to the axis of said cylinder, annular bearing means rigidly attached to said bearing mount and disposed to carry an end of said shaft of said cylinder, adjustable positioning means for separately moving said legs of said bearing mount to selected positions relative to the guide asociated therewith and for holding said bearing mount legs at said selected positions.

2. Apparatus according to claim 1 wherein said adjustable positioning means comprises a pair of threaded rods each extending in a plane perpendicular to said cylinder and through one of said guides for carrying the associated one of said legs and wherein each of said guides is a mounting block arranged in alignment either side of said bearing means and is bored and tapped to receive said threaded rods.

3. Apparatus according to claim 2 wherein said adjustable positioning means further comprising a pair of coil springs maintained under compression between said guides and said bearing mount.

4. Apparatus according to claim 1 further comprising tactile indicator means operatively associated with said adjustable positioning means to indicate the degree of adjustment of said adjustable positioning means.

5. Apparatus according to claim 4 further characterized in that said tactile indicator means repetitively alters the resistance to movement of said adjustable positioning means for each movement thereof over a prescribed distance.

6. Apparatus according to claim 1 further characterized in that said bearing mount is comprised of a pair of bearing support sections releasably fastenable together, each bearing support section defining an interior semicircular bearing surface thereby allowing withdrawal of said cylinder from constraint by said bearings when said bearing support sections are released from each other wherein one of said bearing support sections is secured in fixed disposition relative to said support yoke.

7. A form roller compensator for use in adjustably mounting a form roller relative to a printing cylinder in a printing machine, including a pair of form roller bearing adjusters at each end of said form roller for receiving opposing ends of a shaft upon which said form roller is mounted; each comprising:

vertically separated guide means oriented in a plane perpendicular to said form roller alignment for attachment to a printing machine frame, articulated bearing mount means having vertically separated horizontally disposed legs rotatably joined to a support yoke located therebetween, wherein each leg is reciprocal along a single one of said guide means independent of movement of the other of said legs, annular bearings secured within said bearing mount means and directed toward each other to receive ends of said shaft, and adjustable positioning means providing continuous adjustment for selectively altering the distance of said bearings relative to said printing cylinder, whereby the distance between the axis of said form roller and the axis of said printing cylinder may be altered by shifting of said axis of said form roller.

8. Apparatus according to claim 7 wherein said adjustable positioning means includes threadably engaged members for effectuating said continuous adjustment.

* * * * *